US007901561B2

(12) United States Patent
Johansen et al.

(10) Patent No.: US 7,901,561 B2
(45) Date of Patent: Mar. 8, 2011

(54) METHOD FOR ELECTROLYTIC PRODUCTION AND REFINING OF METALS

(75) Inventors: Kai Johansen, Kristiansand (NO); Donald R. Sadoway, Watertown, MA (US); Bjorn Myhre, Kristiansand (NO); Marianne Engvoll, Kristansand (NO); Krister Engvoll, Kristiansand (NO)

(73) Assignee: Elkem AS, Oslo (NO)

( * ) Notice: Subject to any disclaimer, the term of this patent is extended or adjusted under 35 U.S.C. 154(b) by 1036 days.

(21) Appl. No.: 11/682,457

(22) Filed: Mar. 6, 2007

(65) Prior Publication Data

US 2007/0215483 A1 Sep. 20, 2007

Related U.S. Application Data

(63) Continuation-in-part of application No. 11/372,875, filed on Mar. 10, 2006, now abandoned.

(60) Provisional application No. 60/807,400, filed on Jul. 14, 2006.

(51) Int. Cl.
*C25C 3/28* (2006.01)
*C25C 3/34* (2006.01)

(52) U.S. Cl. ..... 205/410; 205/398; 205/399; 205/401; 205/367

(58) Field of Classification Search ..... 205/410
See application file for complete search history.

(56) References Cited

U.S. PATENT DOCUMENTS 1,534,318 A 4/1925 Hoopes et al.

(Continued)

FOREIGN PATENT DOCUMENTS

FR 2559473 8/1985

OTHER PUBLICATIONS

Office action dated Nov. 1, 2010 issued in corresponding Canadian patent application No. 2,645,161.

*Primary Examiner* — Harry D Wilkins, III
(74) *Attorney, Agent, or Firm* — Lucas & Mercanti, LLP

(57) ABSTRACT

The present invention relates to a method for electrolytic production and refining of metals having a melting point above about 1000° C., particularly silicon, where there is provided a first electrolytic cell having an upper molten electrolyte layer of a first electrolyte, a lower molten alloy layer of an alloy of the metal to be refined and at least one metal more noble than the metal to be refined. The lower alloy layer is the cathode in the first cell and an anode is positioned in the upper molten electrolyte layer. A second electrolytic cell is also provided with an upper molten metal layer of the same metal as the metal to be refined, said layer constituting a cathode, a lower molten alloy layer, said lower layer constituting an anode, said alloy having a higher density than the metal to be refined, and an intermediate molten electrolyte layer having a density between the density of the upper and lower molten layers. Both electrolytes are oxide based electrolytes containing oxide of the metal to be refined, and the electrolyte is in molten state and has a melting point below the operating temperature of the process. Raw material comprising an oxide of the metal to be refined is added to the first cell and direct electric current is passed through the anode to the cathode such that the metal to be refined is moved from the anode and deposited in molten state at the cathode. The two cells can be operated in two separate steps. One to produce an alloy and the other to refine metal from the alloy.

44 Claims, 2 Drawing Sheets

U.S. PATENT DOCUMENTS

| | | | | | |
|---|---|---|---|---|---|
| 3,036,961 | A | | 5/1962 | Herasymenko et al. | |
| 3,203,883 | A | | 8/1965 | Ototani et al. | |
| 3,219,561 | A | | 11/1965 | Monnier et al. | |
| 3,254,010 | A | | 5/1966 | Monnier et al. | |
| 4,292,145 | A | * | 9/1981 | De Mattei et al. | 205/410 |
| 4,400,247 | A | * | 8/1983 | Ginatta | 205/354 |
| 4,448,651 | A | * | 5/1984 | Olson et al. | 205/76 |
| 4,481,232 | A | | 11/1984 | Olson et al. | |
| 4,552,637 | A | | 11/1985 | Vire et al. | |
| 4,973,390 | A | * | 11/1990 | Christini et al. | 205/407 |
| 5,593,566 | A | * | 1/1997 | Sharma | 205/363 |
| 5,976,345 | A | * | 11/1999 | Pal et al. | 205/336 |
| 6,299,742 | B1 | | 10/2001 | Pal et al. | |
| 6,974,534 | B2 | * | 12/2005 | Stubergh | 205/410 |
| 2003/0047463 | A1 | * | 3/2003 | Ward-Close et al. | 205/538 |

* cited by examiner

METHOD FOR ELECTROLYTIC PRODUCTION AND REFINING OF METALS

CROSS-REFERENCE TO RELATED APPLICATIONS

This Application is Continuation-in-part of U.S. patent application Ser. No. 11/372,875 filed Mar. 10, 2006 now abandoned and claims the priority thereof, and claims the priority of U.S. Provisional Application No. 60/807,400 filed Jul. 14, 2006; both Applications are incorporated herein by reference.

FIELD OF INVENTION

The present invention relates to a method for electrolytic production and refining of metals having a high melting point at above about 1000° C., particularly silicon.

BACKGROUND TECHNOLOGY

There is a growing demand for high purity metals, particularly high purity silicon of solar grade and electronic grade. Solar grade silicon feedstock for solar cells has been based on scrap/rejects from electronic grade silicon from the semiconductor industry. Electronic grade silicon is produced by production of silane from metallurgical silicon and gas phase reduction of silane to silicon. This process is, however, very costly. In addition the availability of scrap/rejects from the semiconductor industry is now too small to supply the fast growing solar cell market.

From U.S. Pat. No. 3,219,561 it is known a method for producing refined silicon and germanium by passing a direct current between an anode in contact with a molten salt bath containing a fluoride and an oxide of silicon or germanium and a cathode in contact with another molten salt bath containing of fluoride where the baths are separated by a molten alloy of silicon or germanium and another metal to reduce the oxide of silicon or germanium to silicon or germanium and deposit it on the cathode. In this electrolytic process the silicon or germanium are deposited as a solid on the cathode. The solid metal has to be removed from the cathode and has to be crushed and treated by acids in order to remove impurities trapped in the metal deposited on the cathode.

In U.S. Pat. No. 3,254,010 there is disclosed another method for refining impure silicon or germanium where a current is passed between a cathode and an anode through a molten salt electrolyte containing a fluoride, where the anode is made from impure silicon or germanium or alloys of impure silicon or germanium with more noble metals than silicon or germanium to deport on the cathode refined silicon or germanium. Also in this process solid refined silicon or solid refined germanium are deposited on the cathode. The electrolyte is preferably cryolite. The process of U.S. Pat. No. 3,254,010 thus has the same drawbacks as the method of U.S. Pat. No. 3,219,561.

Finally, for metals having relatively low melting points such as aluminium, electrolytic refining is a conventional process and is described in U.S. Pat. No. 1,534,318. In this patent it is described a process for electrolytic refining of aluminium where there is established a lower layer of molten metal containing aluminium as an anode, an upper layer or of molten aluminium as cathode and an intermediate layer of molten electrolyte of a greater density than the molten aluminium, which electrolyte is essentially fluorides and substantially free from chloride. Current is passed from the anode metal through the electrolyte to the aluminium cathode where aluminium is removed from the anode metal and deposited in the molten state at the cathode. The molten electrolyte contains aluminium and sodium fluorides and between 20 and 60% of fluoride of an alkali earth metal having an atomic weight greater than 80, for example barium fluoride.

The above process disclosed in U.S. Pat. No. 1,534,318 can, however, not be used for electrolytic refining of metals having a high melting point of above 1000° C. since a lot of fluoride vapour would form in the fluoride-based molten electrolyte at such high temperatures destroying the properties of the electrolyte.

There is therefore a need for a process whereby high purity, high melting metals such as silicon can be refined by an electrolytic refining process.

DESCRIPTION OF THE INVENTION

It is an object of the present invention to provide an electrolytic method for production and refining of metals of high melting points above the about 1000° C., particularly silicon, where the refined metal is in molten state.

The present invention thus relates to an electrolytic method for production and of refining of metals having a melting point above about 1000° C., particularly silicon, said method being characterized in that it:

(a) provides to a first electrolytic cell, an upper molten electrolyte layer comprising a first oxide-based electrolyte containing an oxide of the metal to be refined, wherein the first electrolyte is in a molten state and has a melting point below the operating temperature of the process, an anode positioned in the upper molten electrolytic layer, and a lower molten alloy layer comprising an alloy of the metal to be refined and at least one metal more noble than the metal to be refined, said alloy constituting a cathode in the first electrolytic cell, said first electrolyte having a density less than the density of the alloy;

(b) adds a raw material to said upper molten electrolyte layer, the raw material comprising a metal oxide of the metal to be refined;

(c) passes a direct current through the anode to the cathode for reducing the metal oxide to produce an alloy having a higher concentration of the metal to be refined;

(d) transfers the alloy of the lower molten alloy layer of the first electrolytic cell to a second electrolytic cell so as to provide a lower molten alloy layer comprising the alloy to a second electrolytic cell, said alloy constituting an anode in the second electrolytic cell;

(e) provides to the second electrolytic cell an upper molten metal layer comprising a metal of the same metal as the metal to be refined, said upper molten metal layer constituting a cathode, and an intermediate molten electrolyte layer comprising a second oxide-based electrolyte containing an oxide of the metal to be refined, where the second electrolyte is in a molten state and has a melting point below the operating temperature of the process, said second electrolyte having a density between the density of the upper molten metal layer and lower molten alloy layer; and (f) passes a direct electric current through the anode to the cathode of the second electrolytic cell whereby the metal to be refined moves from the anode alloy to the upper molten metal layer.

Using the two electrolytic cells of the present invention, the first cell produces an alloy from the raw material and the second cell refines the alloy to produce a metal.

In the first cell, direct current passes through the anode, the first electrolyte and the cathode alloy to produce an alloy having a higher concentration of the metal to be refined in the alloy layer from the raw material.

In the second cell, direct current passes through the anode alloy, the second electrolyte and the metal to refine the alloy to the metal.

The two cells can also be operated independent of one another. Thus, the method of the present invention can be defined as a two-step process. The first step is producing an alloy from raw material in one electrolytic cell; and the second step is refining an alloy to make a metal.

The alloy is preferably transferred from the first electrolytic cell to the second electrolytic cell in fluid state, but the alloy may also be tapped from the first electrolytic cell, solidified and supplied to the second electrolytic cell in solid state.

Broadly, the method to electrolytically produce an alloy comprising a first and second metal, in accordance with the present invention characterized in that it:

(a) provides to a first electrolytic cell, an upper molten electrolyte layer comprising a first oxide-based electrolyte containing an oxide of the first metal wherein the first electrolyte is in a molten state and has a melting point below the operating temperature of the process, an anode positioned in the upper molten electrolytic layer, and a lower molten alloy layer comprising an alloy of the first metal and the second metal, wherein the second metal is more noble than the first metal, said alloy constituting a cathode in the first electrolytic cell, said first electrolyte having a density less than the density of the alloy;

(b) adds a raw material to said upper molten electrolyte layer, the raw material comprising a metal oxide of the first metal; and (c) passes a direct current from the anode to the cathode alloy to in the first electrolytic cell to produce an alloy having a higher concentration of the first metal.

The raw material is any conventional source of metal oxide containing the metal to be refined, or the first metal, for example, quartz for silicon or rutile for titanium.

The refining method of the present invention can use alloy made from a different process than the first step of the present invention.

Broadly, the method to electrolytically refine the alloy to the metal in accordance with the present invention is characterized in that it:

(a) provides to a second electrolytic cell an upper molten metal layer comprising a metal of the same metal as the metal to be refined, said upper molten metal layer constituting a cathode, a lower molten alloy layer comprising an alloy of the metal to be refined and at least one metal more noble than the metal to be refined said lower layer constituting an anode, and an intermediate molten electrolyte layer comprising a second oxide-based electrolyte containing an oxide of the metal to be refined where the second electrolyte is in molten state and has a melting point below the operating temperature of the process, said second electrolyte having a density between the density of the upper molten metal layer and lower molten alloy layer; and (b) passes a direct electric current from the anode alloy through the second electrolyte to the cathode whereby the metal to be refined is moved from the alloy and deposited in molten state at the cathode.

The metal to be produced and refined is, in addition to silicon, titanium and scandium.

In the refining process, both the alloy as well as a less pure metal of the metal to be refined can be added to the alloy layer. For example, metallurgical grade silicon can be added to the alloy layer, thereby becoming refined.

One of the unique aspects of the present invention is that a variety of raw material can be used in the first cell. Normal carbothermic production of metal puts constraints on the type of raw material used and introduces into the metal impurities especially through the carbon source. Any particulate form of raw material can be added to the first cell and the impurities from the carbon source are eliminated since no carbon source is necessary. This means that the alloy can be purer than conventional alloys and assists in the refining process of the present invention.

As noted, the alloy used in the refining need not be the alloy made in accordance with the present invention.

When the process is first started, the alloy layer can comprise an alloy of the metal to be refined and a metal or metals more noble than the metal to be refined, called the second metal, or the second metal, alone. During the running of the process, the alloy itself will form as the metal to be refined or the first metal moves into the alloy layer.

The lower molten alloy layer comprising the alloy of the metal to be refined or the first metal and at least one metal more noble than the metal to be refined or the second metal must have a composition that meets the following requirements:

- a density greater than the density of the molten first and second electrolyte; and
- a melting point close to or below the melting point of the metal to be refined, so that it is molten and can I-low at the operating temperatures of the method of the invention.

Particularly for the refining of silicon the lower molten alloy layer may for example consist of Si—Cu alloy, FeSi alloy or Cu—Fe—Si alloy. These alloys have melting points well below the melting point of silicon and accordingly also below the melting temperature of the first and second electrolyte.

The first oxide-based electrolyte must have a composition that meets the following requirements:

- must have a density at the operating temperature, which is less than the density of the lower alloy layer of the alloy containing the metal to be refined;
- must have a melting point below the operating temperature;
- must have solubility for ions of the metal to be refined;
- the main constituents of the oxide-base electrolyte must be less noble than the metal to be refined; and
- must contain an oxide of the metal to be refined, for example, $SiO_2$ for silicon.

The second oxide-based electrolyte must have a composition that meets the requirements of the first oxide-based electrolyte, and it must have a density at the operating temperature which is greater than the density of the metal to be refined.

The oxide-based electrolytes further have the advantages that oxides are non-toxic and have low vapour pressures. Another advantage is that used oxide-based electrolytes are non-toxic and do not have to be deposited as special waste. The non-toxic nature of the electrolytes is true except for those which contain barium oxide, because barium oxide is considered toxic.

For the present invention, and especially for silicon, the following oxide based electrolytes are suitable:

- $CaO—SiO_2$, preferably containing 40-75 wt % $SiO_2$
- $CaO—MgO—SiO_2$ having a MgO content of up to 40%
- $CaO—Al_2O_3—SiO_2$ having a $Al_2O_3$ content up to 50%
- $Al_2O_3—CaO—SiO_2—TiO_2$
- $BaO—SiO_2$, preferably containing 25-60 wt % $SiO_2$
- $BaO—TiO_2—SiO_2$, preferably about 10-50 wt % BaO, about 10-50 wt % $TiO_2$ and about 10-50 wt % $SiO_2$ $CaO—TiO_2—SiO_2$, preferably about 10-50 wt % CaO, about 10-50 wt % $TiO_2$ and about 10-50 wt % $SiO_2$ $MgO—TiO_2—SiO_2$, preferably about 10-50 wt % MgO, about 10-50 wt % $TiO_2$ and about 10-50 wt % $SiO_2$ $Al_2O_3—CaO—MgO—SiO_2$, and $CaO—MgO—SiO_2—TiO_2$ In addition halides, particularly alkali and alkaline earth fluorides, may be added to the oxide-based electrolytes in order to modify the viscosity, density, melting point and electric conductivity of the electrolytes. The amount of halides added to the oxide-based electrolytes is preferably below 20 wt % and more preferably below 7 wt %.

Particularly for silicon, the oxide-based electrolytes should have a density above about 2.57 g/cm$^3$ which is the density of molten silicon at the melting point of silicon, and below about 3.37 g/cm$^3$ if 75% FeSi is used as alloy and below about 5.5 g/cm$^3$ if 50% FeSi is used as alloy. For silicon the oxide-based electrolytes must have a melting point close to or below the melting point of silicon which is 1414° C.

A particular suitable oxide-based electrolyte for silicon is a $CaO—SiO_2$ electrolyte containing 40-75% $SiO_2$. This electrolyte has a density of between about 2.5 g/cm$^3$ and about 2.7 g/cm$^3$ and has a high solubility of Si-ions, low solubility of Si and low volatility at an operating temperature above the melting point of silicon.

The first and second electrolyte can have the same composition or they can be different. The second electrolyte must have a density in the molten state such that it forms the intermediate molten electrolyte layer and positions itself between the upper molten metal layer and the lower molten alloy layer. The first electrolyte is not so constrained. The first electrolyte must have a density in the molten state such that it floats on top of the lower molten alloy layer, i.e. has a density less than the molten alloy. However, the first electrolyte need not have a density in the molten state that is greater than metal in the molten state.

Either the production of the alloy or the refining method of the present invention can be performed in suitable conventional vessels that have a heat resistant refractory lining such as alumina, magnesia silicon nitride, silicon carbide or graphite. The side walls of the vessel may favourably be provided with conventional cooling systems, such as evaporation cooled elements in order to create a freeze lining on the inside of the side walls of the vessels.

In the present invention, when the method entails simultaneously producing and refining where separate vessels are employed, they may be in fluid communication with each other, such as through a pipe in the side wall of both vessels. The port for the pipe in both side walls must be positioned below the level of the bottom molten alloy layer, in other words, the top of the molten alloy layer should be above the level of the ports for the pipe which provides fluid communication between the vessels. In such an arrangement, one vessel acts as the first electrolytic cell to produce the alloy and the other vessel acts as the second electrolytic cell for refining.

Preferably, a single vessel is used for simultaneously making the alloy and refining the metal, wherein the vessel has been divided into the first electrolytic cell and the second electrolytic cell and the two cells are in fluid communication with each other through the alloy layer. Such an arrangement is shown in U.S. Pat. No. 3,219,561, issued Nov. 23, 1965, the contents of which are incorporated herein by reference.

In the arrangements for the simultaneous making of the alloy and refining the metal, the two electrolytes are separate from each other and do not contaminate each other.

In either arrangement, the anodes and the cathodes are connected to a direct current source in a conventional way in order to supply direct current for the method.

When direct current is passed through the electrolytic cell or cells, the metal to be refined, for example, silicon in the alloy enters the second oxide-based electrolyte together with ions of any impurities in the alloy that is electrochemically less noble than silicon. Since silicon is the noblest element of the second electrolyte, silicon ions will be reduced at the cathode and will form molten pure silicon, which is collected in the molten silicon cathode. Thus impurities more noble than silicon are trapped in the alloy layer while impurities less noble than silicon are trapped in the second electrolyte.

The refining method of the present invention can be carried out both as a batch process and as a continuous process.

When the refining method is carried out as a batch process, alloy is added to the alloy layer continuously or intermittently. Eventually the electrolytes and the alloy will become too high in impurities. The process is then stopped and the electrolytes and the remaining part of the alloy are removed form the cell. New alloy and new oxide-based electrolytes are added together with a start cathode of the metal to be refined, whereafter electric current is again passed through the electrolytic cell.

When the two separate cells are used, a first for production of the alloy and a second for refining, the alloy from the second cell which is depleted of the metal to be refined, is intermittently tapped and added to the first electrolytic cell.

When the refining method of the present invention is carried out as a continuous process, there are arranged means for continuous or intermittent supply of alloy, means for continuous or intermittent removal of oxide-based electrolytes and means for continuous or intermittent supply of fresh oxide-based electrolytes. Finally there are arranged means for continuous or intermittent tapping of refined metal from the upper molten metal layer. The reason for removal of alloy is that the alloy will, during electrolysis get an increased content of impurity elements more noble than the metal to be refined. Also, during electrolysis the electrolytes will get an increased content of elements less noble than the metal to be refined, and to reduce this content of impurity elements, part of the electrolytes are removed and may after purification be returned to the electrolyte layers in the cell or be deposited.

In a similar manner, the method for both making the alloy and refining the metal can be carried out as either a batch or a continuous process.

By the present invention it is thus provided a simple cost effective method for obtaining a pure form of metals, especially, silicon. Low cost alloys of the metal to be refined and a metal more noble than the metal to be refined can be used as the alloy. For silicon, silicon alloys such as FeSi alloys and Cu—Si alloys can be used as alloy. Such alloys can be produced in accordance with the present invention or in any conventional manner using any conventional means.

SHORT DESCRIPTION OF THE DRAWINGS

DETAILED DESCRIPTION OF THE INVENTION

Figure 1:
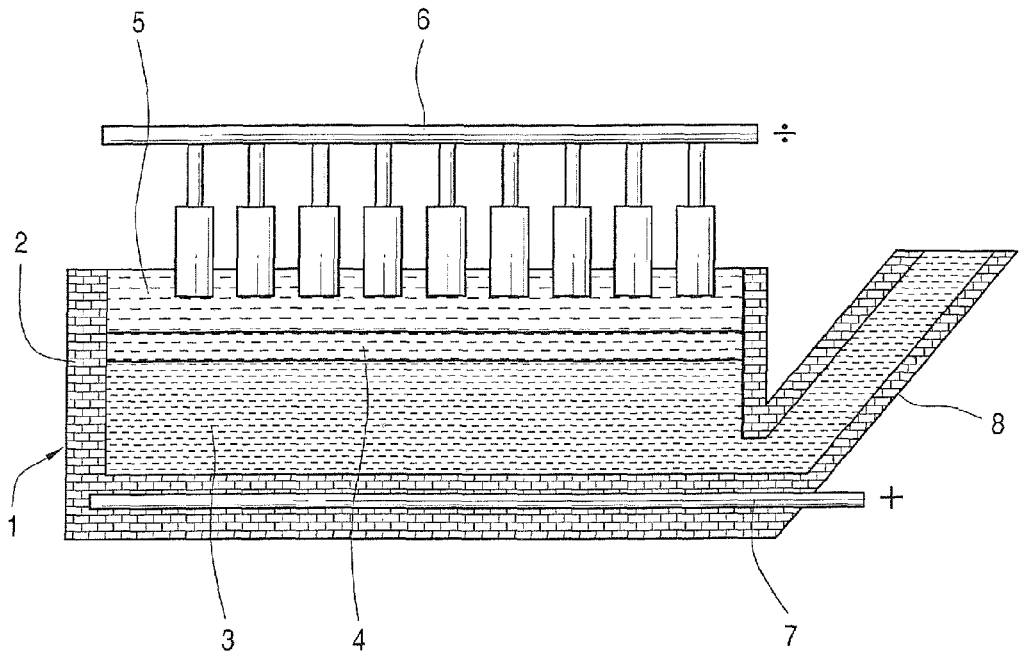
FIG. 1 shows a schematic view of the refining method according to the invention.

1. The present invention provides for a method for producing and refining a metal in an electrolytic method characterized in that:

providing to a first electrolytic cell an upper molten electrolyte later comprising a first oxide-based electrolyte containing an oxide of the metal to be refined and calcium oxide, wherein the first electrolyte is in a molten state and has a melting point below the operating temperature of the process, an anode positioned in the upper molten electrolytic layer, and a lower molten alloy layer comprising an alloy of the metal to be refined and at least one metal more noble than the metal to be refined, said alloy constituting a cathode in the first electrolytic cell, said first electrolyte having a density less than the density of the alloy;

adding raw material to said upper molten electrolyte layer, the raw material comprising a metal oxide of the metal to be refined;

passing a direct current through the anode to the cathode for reducing the metal oxide to produce an alloy having a higher concentration of the metal to be refined;

transferring the alloy of the lower molten allow layer of the first electrolytic cell to a second electrolytic cell so as to provide a lower molten alloy layer comprising the alloy to the second electrolytic cell, said alloy constituting an anode in the second electrolytic cell;

providing to the second electrolytic cell an upper molten metal layer comprising a metal of the same metal as the metal to be refined, said upper molten metal layer constituting a cathode, and an intermediate molten electrolyte layer comprising a second electrolyte having a density between the density of the upper molten metal layer and lower molten alloy layer; and passing a direct electric current through the anode to the cathode of the second electrolytic cell whereby the metal to be refined moves from anode alloy to the upper molten metal layer.

2. The method of 1 wherein the first cell and the second cell are separate vessels that are in fluid communication by a pipe.

3. The method of 1 wherein the first cell and the second cell are in the same vessel and are separated by a wall and are in fluid communication through a space under the wall.

4. The method of 1 wherein the metal to be refined is silicon, titanium or scandium.

5. The method of 1 wherein the first and second electrolyte are the same.

6. The method of 1 wherein the metal more noble than the metal to be refined is copper, iron or silver.

7. Method according to 1, characterized in that the lower molten alloy layer comprises an alloy of the metal to be refined and at least one metal more noble than the metal to be refined, has a melting point below the melting point of the metal to be refined.

8. Method according to 5, characterized in that the oxide-based electrolyte contains up to 20 wt. % of a halide.

9. Method according to 8, characterized in that the oxide-based electrolyte contains up to 7 wt. % of a halide.

10. Method according to 5 for refining of silicon, characterized in that the oxide-based electrolyte contains $CaO—SiO_2$.

11. Method according to 10, characterized in that the oxide-based electrolytes contains 40-75 wt. % $SiO_2$.

12. Method according to 1, characterized in that the oxide-based electrolyte contains an electrolyte selected among $CaO—Al_2O_3—SiO_2$ containing up to 50 wt % $Al_2O_3$, $BaO—SiO_2$, $BaO—TiO_2—SiO_2$, $CaO—TiO_2—SiO_2$, $MgO—TiO_2—SiO_2$, $Al_2O_3—CaO—MgO—SiO_2$, $Al_2O_3—CaO—SiO_2—TiO_2$ containing up to 40 wt % MgO and $CaO—MgO—SiO_2—TiO_2$.

13. Method according to 12, characterized in that the oxide-based electrolyte contains $BaO—SiO_2$ containing 25-60 wt % $SiO_2$.

14. Method according to 12, characterized in that the oxide-based electrolyte contains about 10-50 wt % BaO, about 10-50 wt % $TiO_2$ and about 10-50 wt % $SiO_2$.

15. Method according to 12, characterized in that the oxide-based electrolyte contains about 10-50 wt % CaO, about 10-50% $TiO_2$ and about 10-50% $SiO_2$.

16. Method according to 12, characterized in that the oxide-based electrolyte contains about 10-50 wt % MgO, about 10-50 wt % $TiO_2$ and about 10-50 wt % $SiO_2$.

17. Method according to 1, characterized in that the anode alloy is a Cu—Si alloy.

18. Method according to 1, characterized in that the anode alloy is a ferrosilicon alloy.

19. Method according to 1, characterized in that the anode alloy is a Cu—Fe—Si alloy.

20. A method for electrolytic refining of metals having a melting point above about 1000° C., particularly silicon, characterized in that providing an upper molten metal layer comprising a metal of the same metal as the metal to be refined, said upper molten metal layer constituting a cathode, a lower molten alloy layer comprising an alloy of the metal to be refined and at least one metal more noble than the metal to be refined, said lower molten alloy layer constituting an anode, said alloy having a higher density than the metal to be refined, and an intermediate molten electrolyte layer comprising an oxide-based electrolyte containing an oxide of the metal to be refined and calcium oxide, where the electrolyte is in molten state and has a melting point below the operating temperature of the process, said electrolyte having a density between the density of the upper molten metal layer and lower molten alloy layer; and passing a direct electric current from the anode through the electrolyte to the cathode whereby the metal to be refined is moved from the anode and deposited in molten state at the cathode.

21. Method according to 20, characterized in that the metal to be refined is silicon, titanium or scandium.

22. Method according to 20, characterized in that the lower molten alloy layer comprises an alloy of an alloy of the metal to be refined and at least one metal more noble than the metal to be refined, has a melting point below the melting point of the metal to be refined.

23. Method according to 20, characterized in that the oxide-based electrolyte contains up to 20 wt % of a halide.

24. Method according to 23, characterized in that the oxide-based electrolyte contains up to 7 wt % of a halide.

25. Method according to 20, characterized in that the oxide-based electrolyte contains $CaO—SiO_2$.

26. Method according to 25, characterized in that the first oxide-based electrolyte contains 40-75 wt % $SiO_2$.

27. Method according to 20 for refining of silicon, characterized in that the oxide-based electrolyte contains an electrolyte selected among $CaO—Al_2O_3—SiO_2$ containing up to 50 wt % $Al_2O_3$, $BaO—SiO_2$, $BaO—TiO_2—SiO_2$, $CaO—TiO_2—SiO_2$, $MgO—TiO_2—SiO_2$, $Al_2O_3—CaO—MgO—SiO_2$, $Al_2O_3—CaO—SiO_2—TiO_2$ containing up to 40 wt % MgO and $CaO—MgO—SiO_2—TiO_2$.

28. Method according to 27, characterized in that the oxide-based electrolyte contains $BaO—SiO_2$ containing 25-60 wt % $SiO_2$.

29. Method according to 27, characterized in that the oxide-based electrolyte contains about 10-50 wt % BaO, about 10-50 wt % $TiO_2$ and about 10-50 wt % $SiO_2$.

30. Method according to 27, characterized in that the oxide-based electrolyte contains about 10-50 wt % CaO, about 10-50% $TiO_2$ and about 10-50% $SiO_2$.

31. Method according to 27, characterized in that the oxide-based electrolyte contains about 10-50 wt % MgO, about 10-50 wt % $TiO_2$ and about 10-50 wt % $SiO_2$.

32. Method according to 20, characterized in that the anode alloy is a Cu—Si alloy.

33. Method according to 20, characterized in that the anode alloy is a ferrosilicon alloy.

34. Method according to 20, characterized in that the anode alloy is a Cu—Fe—Si alloy.

35. A method to electrolytically produce an alloy comprising a first and second metal characterized in that:

providing to a first electrolytic cell, an upper molten electrolyte layer comprising a first oxide-based electrolyte containing an oxide of the first metal and calcium oxide wherein the first electrolyte is in a molten state and has a melting point below the operating temperature of the process, an anode positioned in the upper molten electrolytic layer, and a lower molten alloy layer comprising an alloy of the first metal and the second metal wherein the second metal is more noble than the metal to be refined, said alloy constituting a cathode in the first electrolytic cell, said first electrolyte having a density less than the density of the alloy;

adding a raw material to said upper molten electrolyte layer, the raw material comprising a metal oxide of the first metal; and passing a direct current from the anode to the cathode alloy to in the first electrolytic cell to produce an alloy having a higher concentration of the first metal.

36. Method according to 35, characterized in that the metal to be refined is silicon, titanium or scandium.

37. Method according to 35, characterized in that the lower molten alloy layer comprises an alloy of an alloy of the metal to be refined and at least one metal more noble than the metal to be refined, has a melting point below the melting point of the metal to be refined.

38. Method according to 35, characterized in that the oxide-based electrolyte contains up to 20 wt % of a halide.

39. Method according to 38, characterized in that the oxide-based electrolyte contains up to 7 wt % of a halide.

40. Method according to 35, characterized in that the oxide-based electrolyte contains CaO—$SiO_2$.

41. Method according to 40, characterized in that the first oxide-based electrolyte contains 40-75 wt % $SiO_2$.

42. Method according to 35 for refining of silicon, characterized in that the oxide-based electrolyte contains an electrolyte selected among CaO—$Al_2O_3$—$SiO_2$ containing up to 50 wt % $Al_2O_3$, BaO—$SiO_2$, BaO—$TiO_2$—$SiO_2$, CaO—$TiO_2$—$SiO_2$, MgO—$TiO_2$—$SiO_2$, $Al_2O_3$—CaO—MgO—$SiO_2$, $Al_2O_3$—CaO—$SiO_2$—$TiO_2$ containing up to 40 wt % MgO and CaO—MgO—$SiO_2$—$TiO_2$.

43. Method according to 35 characterized in that the alloy is a Cu—Si alloy.

44. Method according to 35 characterized in that the alloy is a ferrosilicon alloy.

In FIG. 1 there it is shown a schematic view of an electrolytic cell for carrying out the method of the present invention for refining of silicon. The electrolytic cell comprises a vessel 1 having a refractory layer 2. In the electrolytic cell there is a lower layer 3 of an alloy of silicon and a metal more noble than silicon such as a Cu—Si alloy that acts as an anode in the electrolytic cell. Above the lower anode layer 3 there is an oxide-based electrolyte 4 having a density lower than the density of the anode alloy 3 and a higher density than molten silicon. A suitable electrolyte 4 is a mixture of 50% by weight of CaO and 50% by weight of $SiO_2$. On the top of the electrolyte layer 4 there is a layer 5 of pure silicon metal acting as a cathode. The anode 4 and the cathode 5 are, via contacts 6 and 7 respectively, connected to a direct current source (not shown) for conducting current to the electrolytic cell. When direct current is passed through the electrolytic cell, silicon in the anode alloy 3 enters the oxide-based electrolyte 4 together with ions of any impurities in the anode alloy 3 that is electrochemically less noble than silicon. Since silicon is the noblest element of the electrolyte 4 silicon ions will be reduced at the cathode 5 and will form molten pure silicon, which is collected in the molten silicon cathode 5. Thus impurities more noble than silicon are trapped in the anode layer 3 while impurities less noble than silicon are trapped in the electrolyte 4. Pure refined silicon is from time to time tapped from the molten cathode layer 5. Additional solid or molten anode alloy or solid or molten unrefined grade of the metal to be refined is continuously or intermittently supplied to the molten anode layer 3 through an anode alloy supply channel 8.

After some time of operation of the electrolytic cell, the anode layer will have an increased content of impurities of metals more noble than silicon and the electrolyte will get an increased content of elements less noble than silicon. The electrolytic cell must therefor be stopped and restarted with pure anode alloy and new uncontaminated electrolyte.

Figure 2:
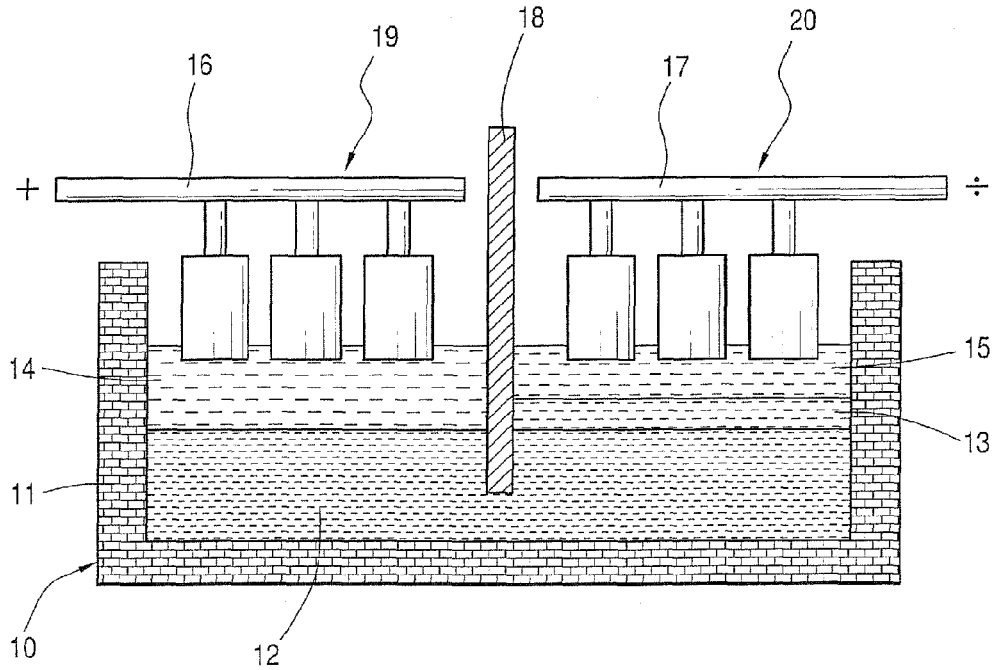
FIG. 2 shows a schematic view of the method for making the alloy and refining the metal according to the invention.

In FIG. 2, vessel 10 has refractory layer 11. Alloy layer 12 comprises the alloy and electrolyte layers 13 contains the second electrolyte and electrolyte layer 14 contains the first electrolyte. Layer 15 is pure metal and acts as cathode. Anode 16 and cathode 17 via conventional contacts are connected to a direct current source, not shown. Wall 18 separates the two cells, the first electrolyte cell 19 and the second electrolytic cell 20. Alloy layer 12 flows between the two cells under wall 18. In the first electrolytic cell 19, raw material, e.g. quartz, $SiO_2$, is reduced electrolytically to metallic state such as silicon to increase the concentration of the metal to be refined in alloy layer 12 and then in the second electrolytic cell 20, the metal to be refined, such as silicon alloy is moved from the anode layer through the second electrolyte layer 13 to the pure metal layer 15. The alloy layer 12 fills the cells to a level above the lower edge of wall 18 and thereby separates the two electrolytes of the two cells. The anode 16 is immersed in electrolyte layer 14 and cathode 17 is immersed in metal layer 15, but neither is in direct contact with alloy layer 12. The alloy layer 12 acts as a common electrode.

The metal to be refined and elements more noble than the metal to be refined that are in the first electrolyte of electrolyte layer 14 precipitate at, and alloy with, the molten alloy.

Anode 16 can be either inert or consumable, such as, baked carbon or graphite.

Figure 3:
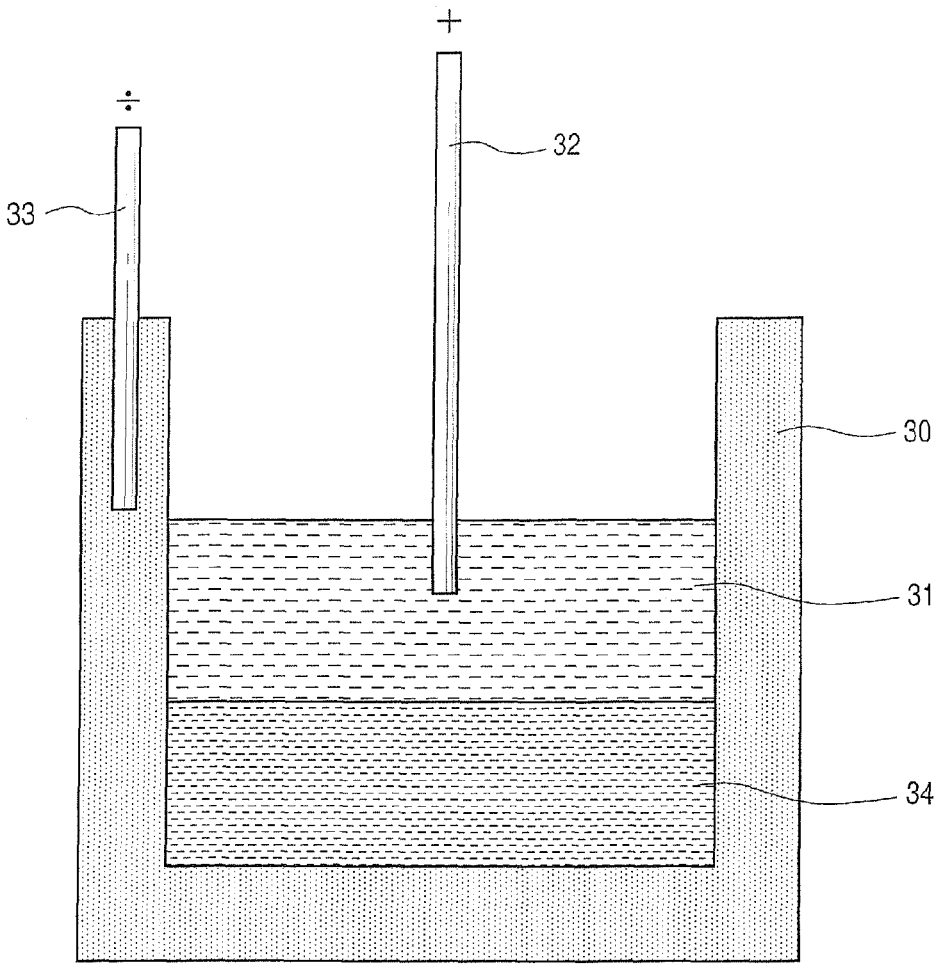
FIG. 3 shows a schematic of a method for producing the alloy.

In FIG. 3, in vessel 30, which was a graphite crucible, electrolyte layer 31 had a composition of 55 wt. % CaO and 45 wt. % $SiO_2$. Raw material of $SiO_2$, quartz, was added frequently to layer 31 to maintain the electrolyte composition and to provide a source of raw material to the process. A voltage of 4.5 V was applied between graphite anode 32 and cathode 33, to give a cathode current density of approximately 1 A/$cm^2$. The cell temperature was held constant at 1650° C. The cell started with a liquid cathode 34 made of copper. The first metal is silicon and the second metal is copper in this cell.

As current flowed through the cell, silicon oxide ions are transported to the cathode where they are reduced to silicon. After 12 hours of electrolysis, the copper cathode contained about 20 wt. % Si, giving a current efficiency of about 40%. Thus, the alloy was produced of SiCu.

As can be seen, this cell started with pure second metal in the alloy layer and through the operation of the cell the alloy is formed in the alloy layer.

The invention claimed is:

1. A method for producing and refining a metal in an electrolytic method characterized in that:

providing to a first electrolytic cell an upper molten electrolyte later comprising a first oxide-based electrolyte containing an oxide of the metal to be refined and calcium oxide, wherein the first electrolyte is in a molten state and has a melting point below the operating temperature of the process, an anode positioned in the upper molten electrolytic layer, and a lower molten alloy layer comprising an alloy of the metal to be refined and at least one metal more noble than the metal to be refined, said alloy constituting a cathode in the first electrolytic cell, said first electrolyte having a density less than the density of the alloy;

adding raw material to said upper molten electrolyte layer, the raw material comprising a metal oxide of the metal to be refined;

passing a direct current through the anode to the cathode for reducing the metal oxide to produce an alloy having a higher concentration of the metal to be refined;

transferring the alloy of the lower molten allow layer of the first electrolytic cell to a second electrolytic cell so as to provide a lower molten alloy layer comprising the alloy to the second electrolytic cell, said alloy constituting an anode in the second electrolytic cell;

providing to the second electrolytic cell an upper molten metal layer comprising a metal of the same metal as the metal to be refined, said upper molten metal layer constituting a cathode, and an intermediate molten electrolyte layer comprising a second electrolyte having a density between the density of the upper molten metal layer and lower molten alloy layer; and passing a direct electric current through the anode to the cathode of the second electrolytic cell whereby the metal to be refined moves from anode alloy to the upper molten metal layer.

2. The method of claim 1 wherein the first cell and the second cell are separate vessels that are in fluid communication by a pipe.

3. The method of claim 1 wherein the first cell and the second cell are in the same vessel and are separated by a wall and are in fluid communication through a space under the wall.

4. The method of claim 1 wherein the metal to be refined is silicon, titanium or scandium.

5. The method of claim 1 wherein the first and second electrolyte are the same.

6. Method according to claim 5, characterized in that the oxide-based electrolyte contains up to 20 wt. % of a halide.

7. Method according to claim 6, characterized in that the oxide-based electrolyte contains up to 7 wt. % of a halide.

8. Method according to claim 5 for refining of silicon, characterized in that the oxide-based electrolyte contains $CaO—SiO_2$.

9. Method according to claim 8, characterized in that the oxide-based electrolytes contains 40-75 wt. % $SiO_2$.

10. The method of claim 1 wherein the metal more noble than the metal to be refined is copper, iron or silver.

11. Method according to claim 1, characterized in that the lower molten alloy layer comprises an alloy of the metal to be refined and at least one metal more noble than the metal to be refined, has a melting point below the melting point of the metal to be refined.

12. Method according to claim 1, characterized in that the oxide-based electrolyte contains an electrolyte selected among $CaO—Al_2O_3—SiO_2$ containing up to 50 wt % $Al_2O_3$, $BaO—SiO_2$, $BaO—TiO_2—SiO_2$, $CaO—TiO_2—SiO_2$, $MgO—TiO_2—SiO_2$, $Al_2O_3—CaO—MgO—SiO_2$, $Al_2O_3—CaO—SiO_2—TiO_2$ containing up to 40 wt % MgO and $CaO—MgO—SiO_2—TiO_2$.

13. Method according to claim 12, characterized in that the oxide-based electrolyte is contains $BaO—SiO_2$ containing 25-60 wt % $SiO_2$.

14. Method according to claim 12, characterized in that the oxide-based electrolyte contains about 10-50 wt % BaO, about 10-50 wt % $TiO_2$ and about 10-50 wt % $SiO_2$.

15. Method according to claim 12, characterized in that the oxide-based electrolyte contains about 10-50 wt % CaO, about 10-50% $TiO_2$ and about 10-50% $SiO_2$.

16. Method according to claim 12, characterized in that the oxide-based electrolyte contains about 10-50 wt % MgO, about 10-50 wt % $TiO_2$ and about 10-50 wt % $SiO_2$.

17. Method according to claim 1, characterized in that the anode alloy is a Cu—Si alloy.

18. Method according to claim 1, characterized in that the anode alloy is a ferrosilicon alloy.

19. Method according to claim 1, characterized in that the anode alloy is a Cu—Fe—Si alloy.

20. A method for electrolytic refining of metals having a melting point above about 1000° C., particularly silicon, characterized in that providing an upper molten metal layer comprising a metal of the same metal as the metal to be refined, said upper molten metal layer constituting a cathode, a lower molten alloy layer comprising an alloy of the metal to be refined and at least one metal more noble than the metal to be refined, said lower molten alloy layer constituting an anode, said alloy having a higher density than the metal to be refined, and an intermediate molten electrolyte layer comprising an oxide-based electrolyte containing an oxide of the metal to be refined and calcium oxide, where the electrolyte is in molten state and has a melting point below the operating temperature of the process, said electrolyte having a density between the density of the upper molten metal layer and lower molten alloy layer; and passing a direct electric current from the anode through the electrolyte to the cathode whereby the metal to be refined is moved from the anode and deposited in molten state at the cathode.

21. Method according to claim 20, characterized in that the metal to be refined is silicon, titanium or scandium.

22. Method according to claim 20, characterized in that the lower molten alloy layer comprises an alloy of an alloy of the metal to be refined and at least one metal more noble than the metal to be refined, has a melting point below the melting point of the metal to be refined.

23. Method according to claim 20, characterized in that the oxide-based electrolyte contains up to 20 wt % of a halide.

24. Method according to claim 23, characterized in that the oxide-based electrolyte contains up to 7 wt % of a halide.

25. Method according to claim 20, characterized in that the oxide-based electrolyte contains $CaO—SiO_2$.

26. Method according to claim 25, characterized in that the first oxide-based electrolyte contains 40-75 wt % $SiO_2$.

27. Method according to claim 20 for refining of silicon, characterized in that the oxide-based electrolyte contains an electrolyte selected among $CaO—Al_2O_3—SiO_2$ containing up to 50 wt % $Al_2O_3$, $BaO—SiO_2$, $BaO—TiO_2—SiO_2$, $CaO—TiO_2—SiO_2$, $MgO—TiO_2—SiO_2$, $Al_2O_3—CaO—$ $MgO—SiO_2$, $Al_2O_3—CaO—SiO_2—TiO_2$ containing up to 40 wt % MgO and $CaO—MgO—SiO_2—TiO_2$.

28. Method according to claim 27, characterized in that the oxide-based electrolyte contains $BaO—SiO_2$ containing 25-60 wt % $SiO_2$.

29. Method according to claim 27, characterized in that the oxide-based electrolyte contains about 10-50 wt % BaO, about 10-50 wt % $TiO_2$ and about 10-50 wt % $SiO_2$.

30. Method according to claim 27, characterized in that the oxide-based electrolyte contains about 10-50 wt % CaO, about 10-50% $TiO_2$ and about 10-50% $SiO_2$.

31. Method according to claim 27, characterized in that the oxide-based electrolyte contains about 10-50 wt % MgO, about 10-50 wt % $TiO_2$ and about 10-50 wt % $SiO_2$.

32. Method according to claim 20, characterized in that the anode alloy is a Cu—Si alloy.

33. Method according to claim 20, characterized in that the anode alloy is a ferrosilicon alloy.

34. Method according to claim 20, characterized in that the anode alloy is a Cu—Fe—Si alloy.

35. A method to electrolytically produce an alloy comprising a first and second metal characterized in that:

providing to a first electrolytic cell, an upper molten electrolyte layer comprising a first oxide-based electrolyte containing an oxide of the first metal and calcium oxide wherein the first electrolyte is in a molten state and has a melting point below the operating temperature of the process, an anode positioned in the upper molten electrolytic layer, and a lower molten alloy layer comprising an alloy of the first metal and the second metal wherein the second metal is more noble than the metal to be refined, said alloy constituting a cathode in the first electrolytic cell, said first electrolyte having a density less than the density of the alloy;

adding a raw material to said upper molten electrolyte layer, the raw material comprising a metal oxide of the first metal; and passing a direct current from the anode to the cathode alloy to in the first electrolytic cell to produce an alloy having a higher concentration of the first metal.

36. Method according to claim 35, characterized in that the metal to be refined is silicon, titanium or scandium.

37. Method according to claim 35, characterized in that the lower molten alloy layer comprises an alloy of an alloy of the metal to be refined and at least one metal more noble than the metal to be refined, has a melting point below the melting point of the metal to be refined.

38. Method according to claim 35, characterized in that the oxide-based electrolyte contains up to 20 wt of a halide.

39. Method according to claim 38, characterized in that the oxide-based electrolyte contains up to 7 wt % of a halide.

40. Method according to claim 35, characterized in that the oxide-based electrolyte contains $CaO—SiO_2$.

41. Method according to claim 40, characterized in that the first oxide-based electrolyte contains 40-75 wt $SiO_2$.

42. Method according to claim 35 for refining of silicon, characterized in that the oxide-based electrolyte contains an electrolyte selected among $CaO—Al_2O_3—SiO_2$ containing up to 50 wt % $Al_2O_3$, $BaO—SiO_2$, $BaO—TiO_2—SiO_2$, $CaO—TiO_2—SiO_2$, $MgO—TiO_2—SiO_2$, $Al_2O_3—CaO—MgO—SiO_2$, $Al_2O_3—CaO—SiO_2—TiO_2$ containing up to 40 wt % MgO and $CaO—MgO—SiO_2—TiO_2$.

43. Method according to claim 35 characterized in that the alloy is a Cu—Si alloy.

44. Method according to claim 35 characterized in that the alloy is a ferrosilicon alloy.

* * * * *